US008172580B1

(12) United States Patent
Chen et al.

(10) Patent No.: US 8,172,580 B1
(45) Date of Patent: May 8, 2012

(54) POWER ADAPTER

(75) Inventors: Shih-Hui Chen, Taoyuan Hsieh (TW); Chin-Tien Lin, Taoyuan Hsieh (TW)

(73) Assignee: Tennrich International Corp., Taoyuan Hsieh (TW)

( * ) Notice: Subject to any disclaimer, the term of this patent is extended or adjusted under 35 U.S.C. 154(b) by 0 days.

(21) Appl. No.: 13/033,882

(22) Filed: Feb. 24, 2011

(51) Int. Cl.
*H01R 11/30* (2006.01)

(52) U.S. Cl. ..... 439/39; 320/111

(58) Field of Classification Search ..... 439/39, 439/38, 40, 638, 305; 320/111, 107–116
See application file for complete search history.

(56) References Cited

U.S. PATENT DOCUMENTS 6,727,477 B1 * 4/2004 Li-Chen ..... 219/494
6,856,556 B1 * 2/2005 Hajeck ..... 365/189.11
7,101,226 B1 * 9/2006 Gilliland ..... 439/620.01
7,435,094 B2 * 10/2008 Chang ..... 439/39
2008/0232016 A1 * 9/2008 Chen et al. ..... 361/93.1
2010/0231395 A1 * 9/2010 Chen et al. ..... 340/636.2
* cited by examiner

*Primary Examiner* — Tulsidas C Patel
*Assistant Examiner* — Harshad Patel
(74) *Attorney, Agent, or Firm* — Jackson IPG PLLC; Demian K. Jackson

(57) ABSTRACT

A power adapter conveniently allows an electric device to be quickly disconnected and taken by a user. The power adapter is to dispose a first coupling portion and a second coupling portion at a main body to respectively and electrically connect a power supply device and an electronic product such that a goal of delivering power from the power supply device to the electronic product can be achieved, wherein at least one magnetic attraction portion is disposed to an end of the main body having the first coupling portion or the second coupling portion such that junction effect between the power adapter and the power supply device or the electronic product can be retained by utilizing a magnet attraction performance from the magnetic attraction portion, and the electronic product can be quickly taken by slightly imposing force.

3 Claims, 12 Drawing Sheets

POWER ADAPTER

BACKGROUND OF THE INVENTION

1. Field of the Invention

The present invention relates to a power adapter, and more particularly to the power adapter capable of retaining the junction effect between a power supply device and an electronic product and rapidly using the electronic product by slightly imposing force.

2. Description of the Related Art

Since new technology is continuously developed, people may require electronic products to have more functions, especially for consumer electronics. A conventional electronic product having larger size (e.g. a compact disc player, a telephone or a desktop computer) is simplified to form a portable electronic product with high efficiency (e.g. a multimedia player (MPEG Audio Layer-3, MP3), a mobile phone or a laptop computer) to increase the efficiency for people in daily life.

The power required for the foregoing portable electronic products is mostly adapted with a rechargeable battery such as a nickel-metal hydride battery or a lithium cell. The rechargeable battery is mainly charged by a charging device. The charging device comprises a charging seat and a power source plug. The charging seat and the power source plug are connected by wires, and the charging seat is disposed with a power conversion module and a charging slot so that the rechargeable battery can be placed in the charging slot to supply power for the electronic products during the power charging mode.

Some charging devices integrate the power conversion module into a side of the power source plug and are electrically connected to the electronic products through a wire equipped with an electric connector to supply power for the electronic products during the power charging mode. Moreover, when some portable electronic products are used, a charging device as a movable power is carried to charge the electronic product.

However, the portable electronic products are charged by a power supply system with grid-connection or the movable power source, the portable electronic products are electrically connected to the charging device through wires or the electric connector. While immediately taking the electronic products (e.g. an important call is coming when the mobile phone is charging.), the electronic products are connected with wires which cause inconvenience.

SUMMARY OF THE INVENTION

In view of the shortcomings of the prior art, the inventor(s) of the present invention based on years of experience in the related industry to conduct extensive researches and experiments, and finally developed a power adapter as a principle objective so that a junction effect between a power supply device and an electronic product can be retained, and the electronic product can be quickly taken by slightly imposing force.

To achieve the foregoing objective, the power adapter of the invention is to dispose a first coupling portion and a second coupling portion at a main body to respectively and electrically connect the power supply device and the electronic product such that a goal of delivering power from the power supply device to the electronic product can be achieved, wherein at least one magnetic attraction portion is disposed to an end of the main body having a first coupling portion and the second coupling portion.

While in use, a junction effect between the power adapter and the power supply device or the electronic product can be retained by utilizing a magnet attraction performance of the magnetic attraction portion, and the electronic product can be quickly taken by slightly imposing forces.

When the invention is implemented, the power adapter is equipped with a magnetic attraction portion at an end of the main body having the first coupling portion. The junction effect between the power adapter and the power supply device can be formed by utilizing a magnetic attraction performance.

When the invention is implemented, the power adapter is equipped with a magnetic attraction portion at an end of the main body having the second coupling portion. The junction effect between the power adapter and the electronic product can be formed by utilizing a magnetic attraction performance.

When the invention is implemented, the power adapter is equipped with magnetic attraction portions at two ends of the main body having the first coupling portion and the second coupling portion. The junction effect between the power adapter and the electronic product or the power supply device can be formed by utilizing magnetic attraction performances.

When the invention is implemented, the power adapter is further equipped with a voltage step-down circuit electrically connected to the first coupling portion and the second coupling portion and a detection circuit electrically connected to the second coupling portion and the voltage step-down circuit. An output voltage of the voltage step-down circuit can be automatically regulated through a status of the electronic product detected by the detection circuit, thereby providing power required for charging or operating the electronic product.

DETAILED DESCRIPTION OF THE PREFERRED EMBODIMENTS

The foregoing and other technical characteristics of the present invention will become apparent with the detailed description of the preferred embodiments and the illustration of the related drawings.

Figure 1:
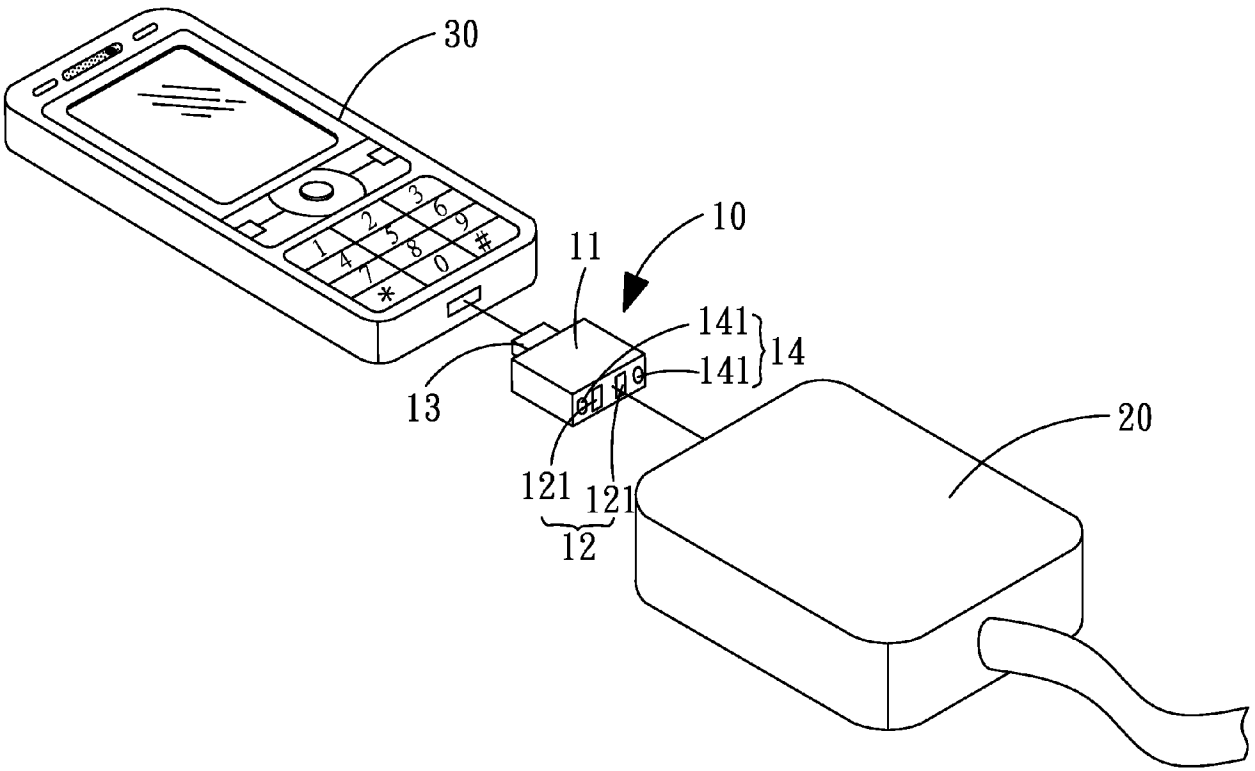
FIG. 1 is a three-dimensional drawing of an appearance of a power adapter according to a first embodiment of the present invention.
Figure 2:
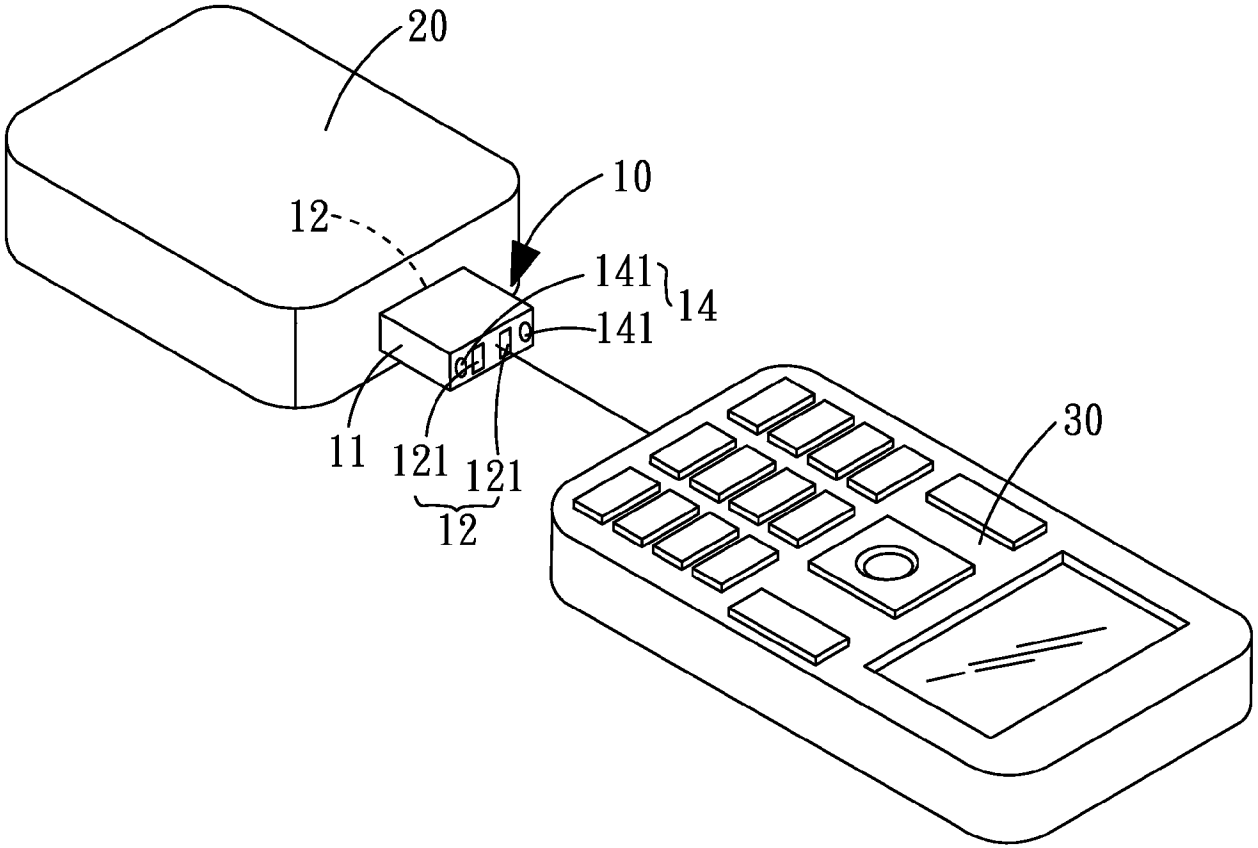
FIG. 2 is a three-dimensional drawing of an appearance of a power adapter according to a second embodiment of the present invention.

With reference to FIG. 1 for a three-dimensional drawing of a power adapter in accordance with a first embodiment of the invention and with reference to FIG. 2 for three-dimensional drawing of a power adapter in accordance with a second embodiment of the invention are depicted. The power adapter 10 of the invention comprises a main body 11, a first coupling portion 12, a second coupling portion 13 and at least one magnetic attraction portion 14.

The first coupling portion 12 is disposed to the main body 11 and has a predetermined number/format of electrode junctions 121 that are electrically connected to a power supply device 20 (e.g. a charger shown in the figure).

The second coupling portion 13 is disposed to the main body 11 to electrically connect the first coupling portion 12. The second coupling portion 13 also has a predetermined number/format of electrode junctions 131 that are electrically connected to an electronic product 30 (e.g. a mobile phone as shown in the figure).

Each magnetic attraction portion 14 as shown in FIG. 1 is disposed to one end of the main body having the first coupling portion 12. Each magnetic attraction portion 14 as shown in FIG. 2 is disposed to one end of the main body having the second coupling portion 13. Alternatively, each magnetic attraction portion 14 is respectively disposed to one end of the main body having the first coupling portion 12, and each magnetic attraction portion 14 is disposed to one end of the second coupling portion 13. Each magnetic attraction portion 14 has at least one permanent magnet 141.

When the power adapter 10 of the invention is in use, the first coupling portion 12 and the second coupling portion 13 at two ends of the main body 10 are utilized to electrically connect the power supply device 20 (e.g. the charger as shown in the figure) and the electronic product 30 (e.g. the mobile phone as shown in the figure) such that goals of delivering power of the power supply device to the electronic product can be achieved. Moreover, the attraction effect of the magnet 141 of the magnetic attraction portion 14 is utilized to maintain the junction effect between the power adapter 10 and the power supply device 20 or the electronic product 30.

Since the power adapter 10 of the invention utilizes the attraction force of the magnet 141 to attract with an iron stock on the power supply device 20 or the electronic product 30 connected to a side of the main body 11, the junction effect between the power adapter 10 and the power supply device 20 or the electronic product 30.

Therefore, when there is an urgent need to use the electronic product 30, the electronic product 30 is separated from the power supply device 20 by slightly imposing force such that the electronic product 30 is quickly taken. More specifically, the power adapter 10 can be retained at a side (or at a side of the electronic product) of the power supply device without influencing the operation of the electronic product 30.

Figure 3:
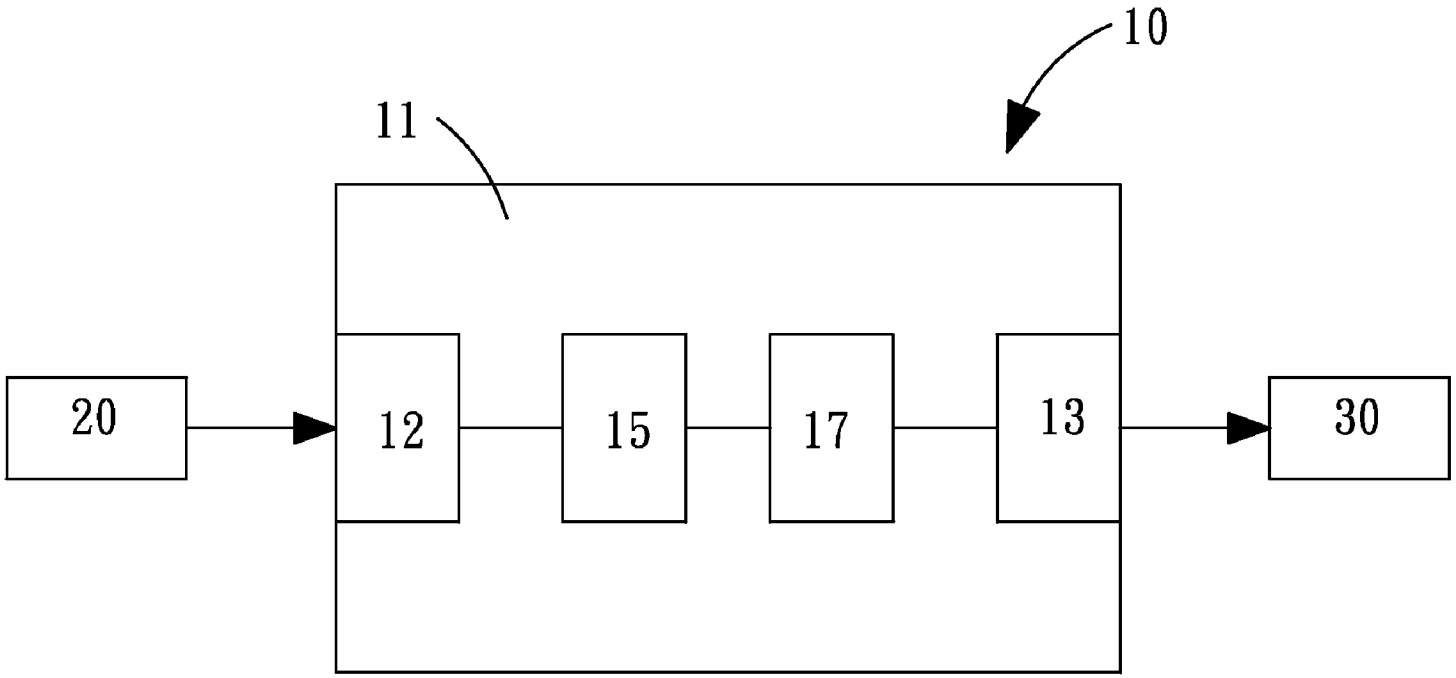
FIG. 3 is a block diagram of an assembled architecture of a power adapter according to a third embodiment of the present invention.

As shown in FIG. 3, when the power adapter of the invention is implemented, the power adapter 10 does not only dispose a voltage step-down circuit 15, which is electrically connected to the first coupling portion 12 and the second coupling portion 13, inside the main body 11, but also disposes a detection circuit 17 electrically connected to the second coupling portion 13 and the voltage step-down circuit 15. The detection circuit 17 is used for detecting the status of the electronic product 30 and automatically regulating the output voltage of the voltage step-down circuit 15 to charge or supply the required power for the electronic product. Moreover, the detection circuit turns off the voltage step-down circuit 15 to stop supplying power to the electronic product 30 when the electronic product 30 is completely charged.

Figure 4:
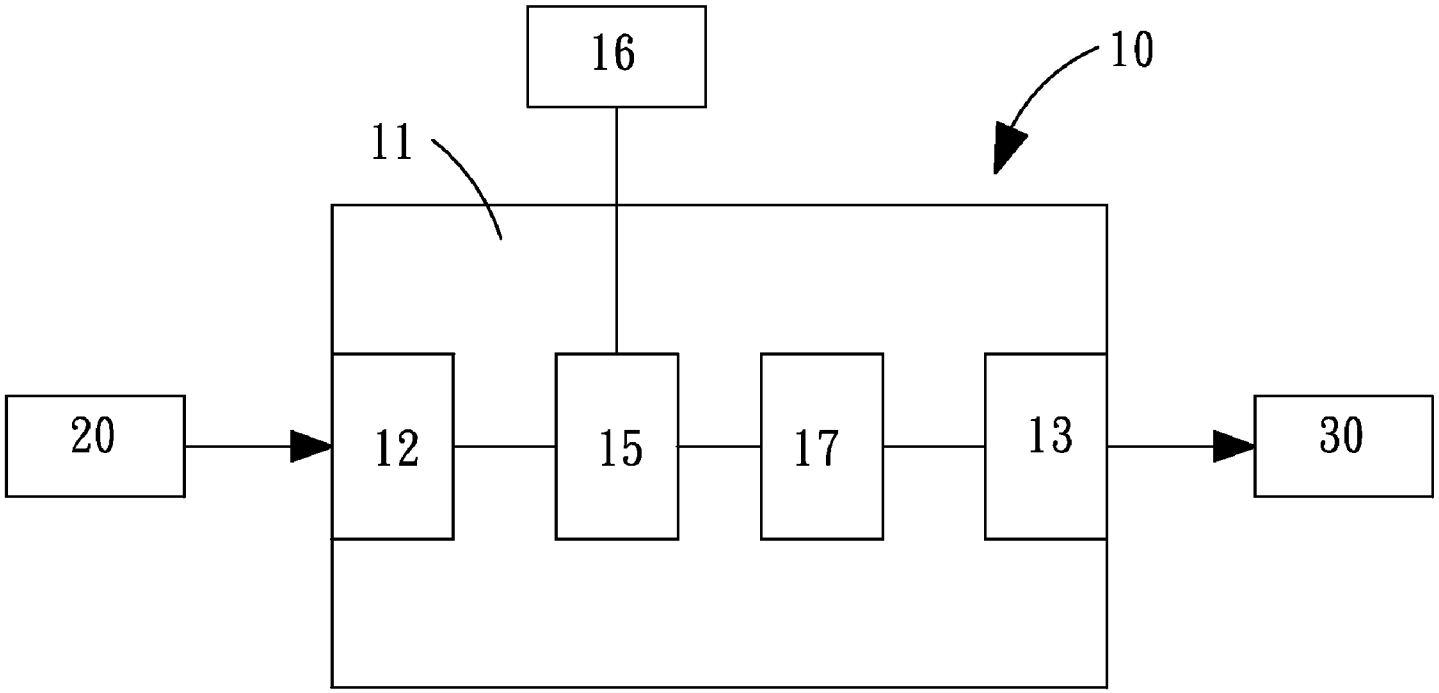
FIG. 4 is a block diagram of an assembled architecture of a power adapter according to a fourth embodiment of the present invention.

As shown in FIG. 4, when the power adapter of the invention is implemented, the power adapter 10 does not only dispose the voltage step-down circuit 15 and the detection circuit 17, but also further disposes a switch 16, which switches the output voltage of the voltage step-down circuit 15, on the main body such that the electronic product 30 is manually switched to charge or provide with the required power based upon the demand of the electronic product 30.

Figure 5:
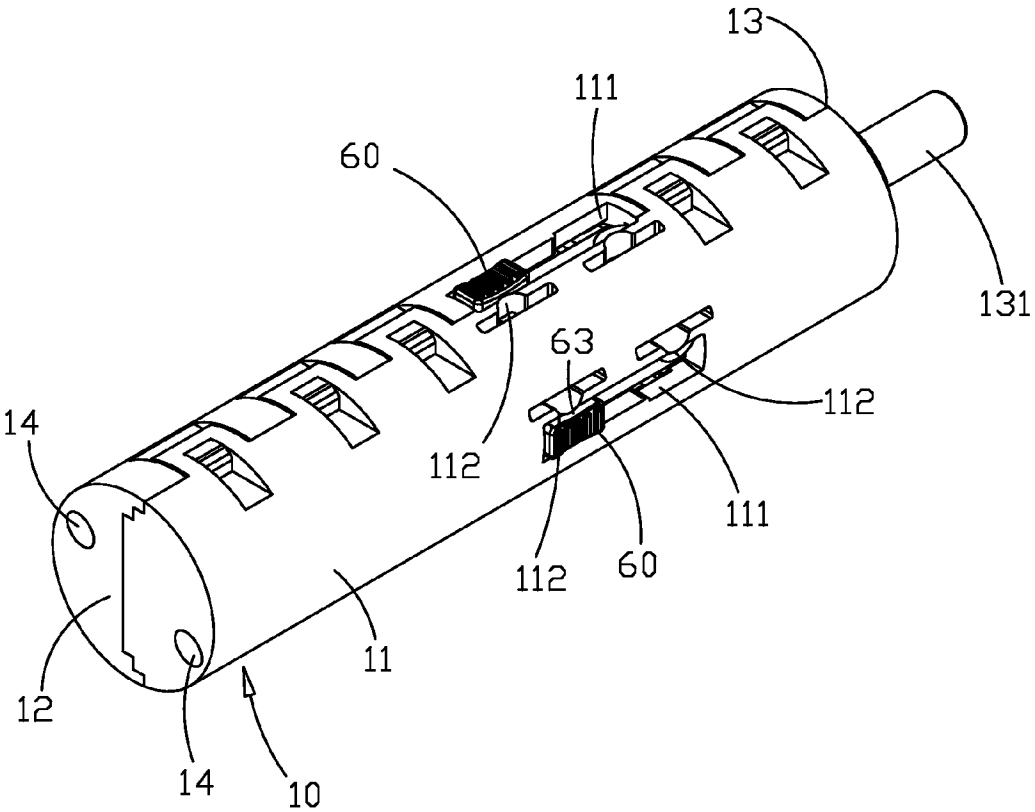
FIG. 5 is a structural diagram of an appearance of a power adapter according to a fifth embodiment of the present invention.
Figure 6:
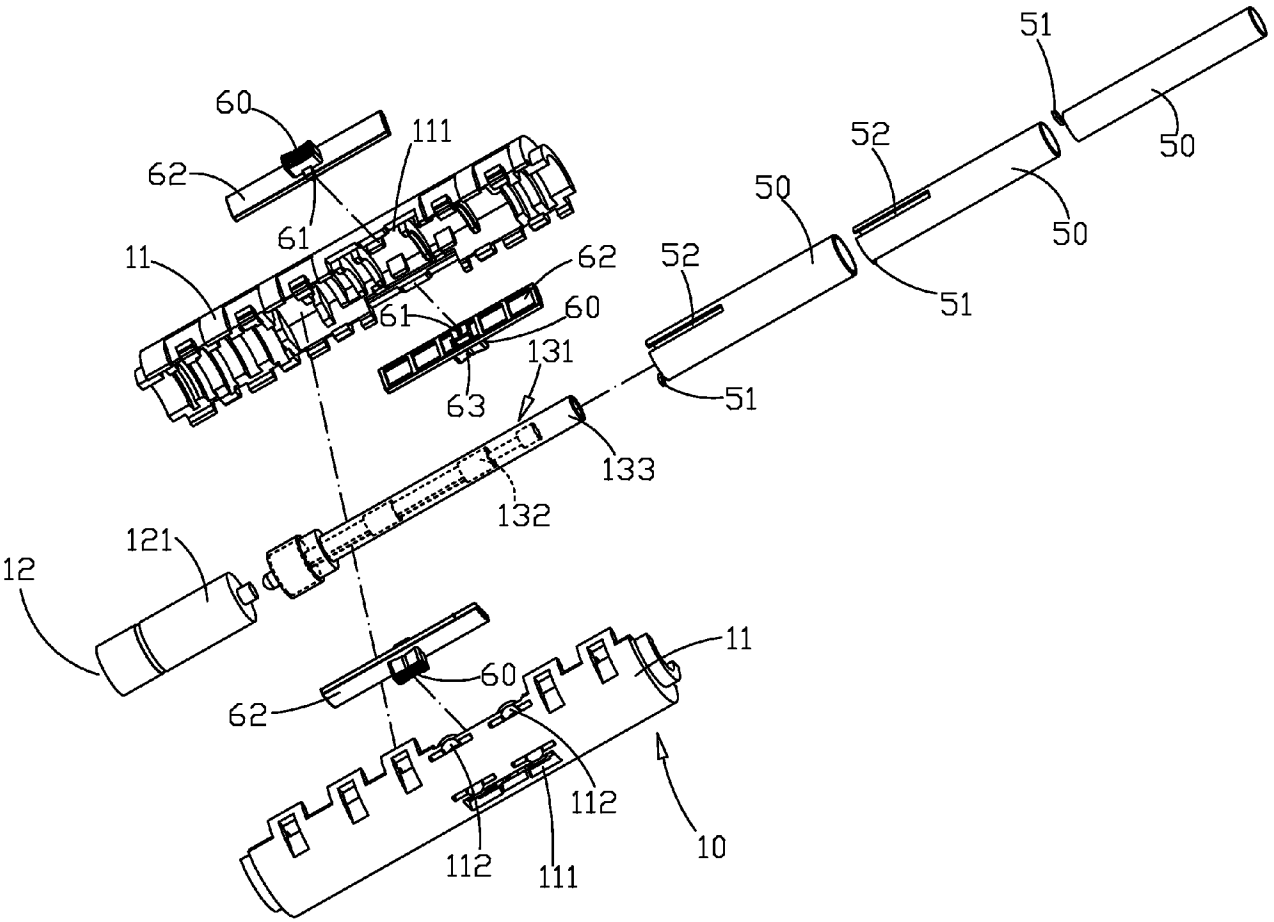
FIG. 6 is a decomposition drawing of a power adapter according to a fifth embodiment of the present invention.

As shown in FIG. 5 and FIG. 6, when the power adapter is implemented, the power adapter 10 comprises a main body 11, a first coupling portion 12, a second coupling portion 13, several movable conduction sleeves 50 and several push buttons 60 corresponding to the movable conduction sleeves 50.

Several slot holes 111 are axially arranged on the main body 11. The first coupling portion 12 is arranged on the main body 11 and has electrode contacts 121 with predetermined numbers/formats. Each magnetic attraction portion 14 can be disposed to one end of the main body having the first coupling portion 12.

The second coupling portion 13 is disposed to the main body 11 to electrically connect the first coupling portion 12. The second coupling portion 13 also has electrode junctions 131 with predetermined numbers/formats. The electrode junction 131 of the second coupling portion 13 has an electrode spindle 132 and an electrode bushing 133 stretching out the main body.

The several movable conduction sleeves 50 are sequentially laminated to an external ring of the electrode bushing 133 and respectively connected to the push button 60 piercing through the main body. Each movable conduction sleeve 50 can be relatively shifted and retain the junction effect. The movable conduction sleeve 50 located to the extreme inner layer nibs against the electrode bushing 133.

Figure 7:
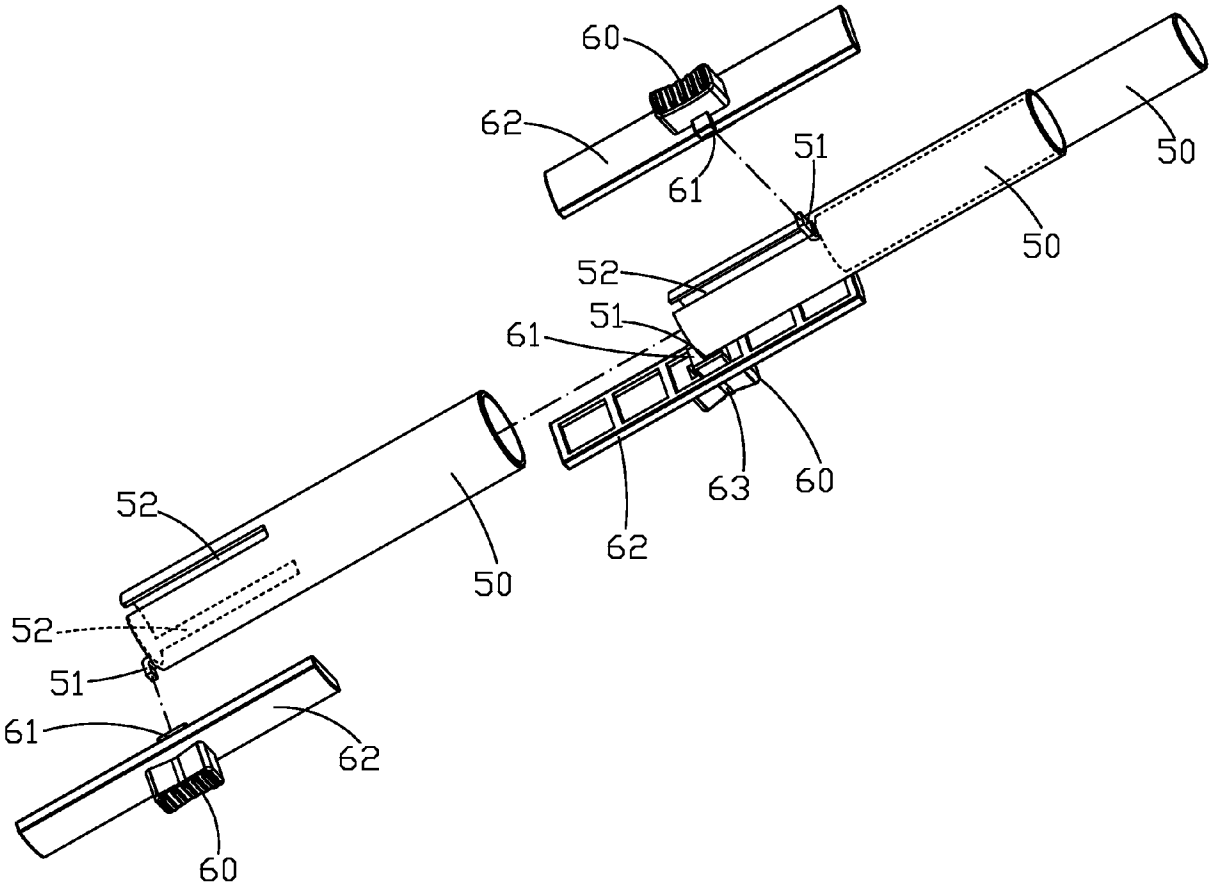
FIG. 7 is a decomposition drawing of a push button and a movable conduction sleeve according to the present invention.
Figure 8:
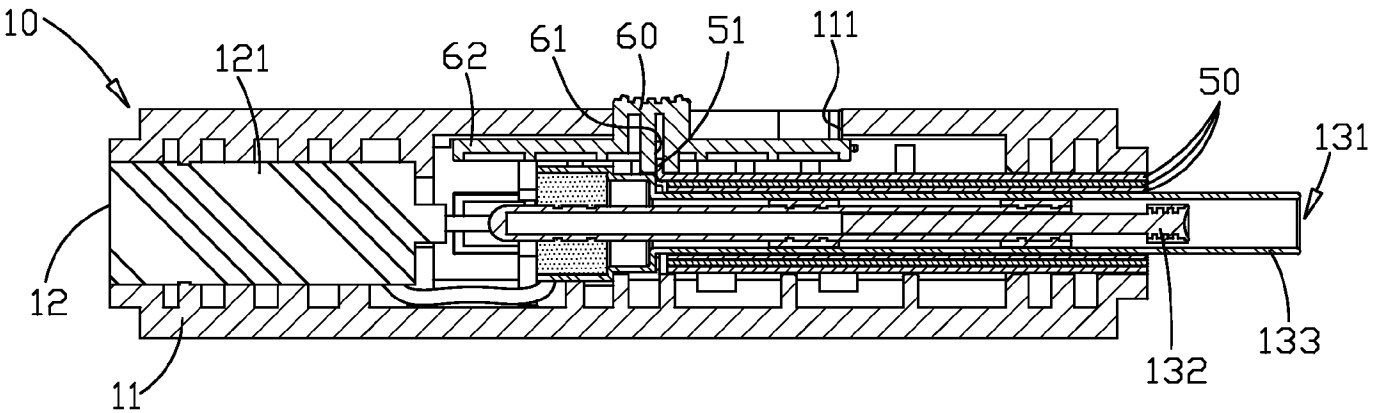
FIG. 8 is a cross-sectional drawing of a structure according to the present invention.
Figure 9:
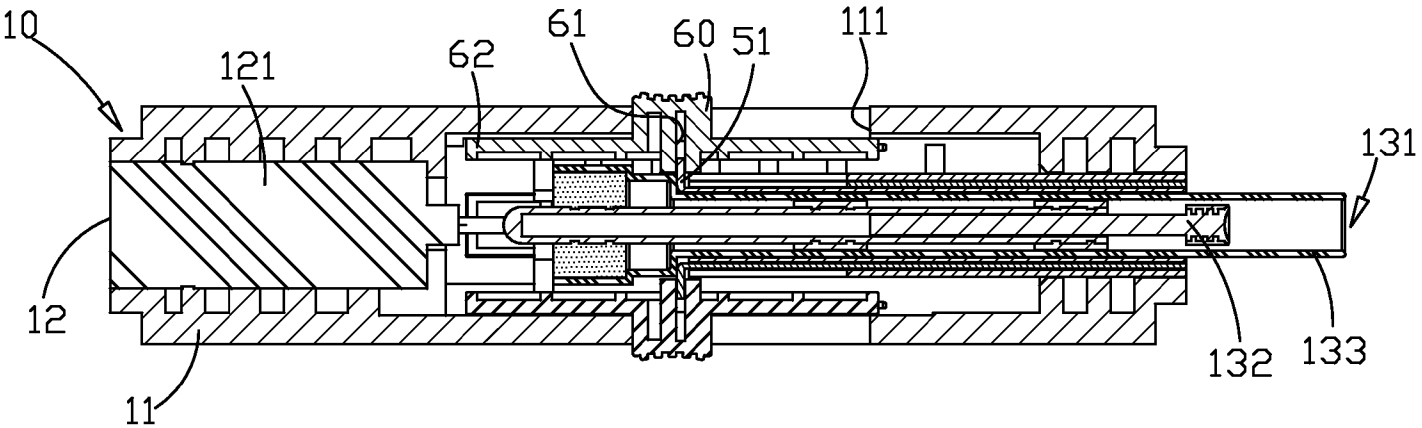
FIG. 9 is a cross-sectional drawing of a structure at another angle according to the present invention.

The several push buttons 60 individually pierce through the slot hole 111 of the main body 11 and are connected to the movable conduction sleeve 50 to form a linking effect together with the movable conduction sleeve 50. While in implementation, as shown in FIG. 7 to FIG. 9, each push button 60 is disposed with a clamping port 61 at a side of the main body 11. A tail of each movable conduction sleeve 50 is bent with a protrusion plate 51 for inserting the clamping port 61 of the push button 60 to form the linking effect between the push button 60 and the movable conduction sleeve 50. More specifically, a tail of the movable conduction sleeve 50, which is relatively disposed to the outer layer, is equipped with a trough 52 that is passed by the protrusion plate 51 of the movable conduction sleeve 50 relatively disposed to the inner layer, thereby relatively reducing the length of the power adapter 10.

Figure 10:
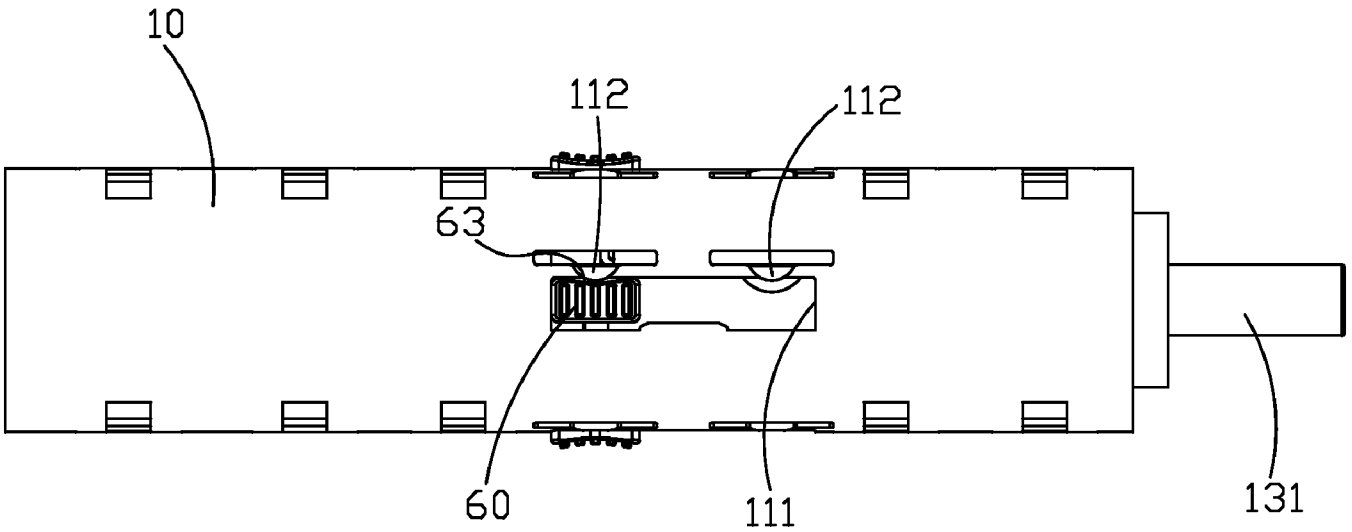
FIG. 10 is a schematic diagram of positioning status of a bush button according to the present invention.

Each push button 60 is disposed with an extending plate 62 for covering the slot hole 111 of the main body 11 and a positioning cavity 63 at its wall surface. The main body 11 has flexible protruding buckles 112 at two ends of the sliding stroke performed by the push button 60 in each slot hole 111 to cross the positioning cavity 63 of the push button 60 as shown in FIG. 10, thereby achieving goals of positioning the push button 60 and the movable conduction sleeve 50.

With reference to FIG. 6 and FIG. 9, when the power adapter 10 of the invention is used, it does not only electrically connect a user object from the electrode contact 131 of the second coupling portion, but also allows the user to selectively push one or multiple movable conduction sleeves 50 toward a front of the main body 11 through the push button 60 relatively appearing the main body 11. The movable conduction sleeves 50 at different positions or having different numbers are utilized to incorporate with the electrode bushing 133 to form a specific externally diameter so as to match the application demand for different objects.

Figure 11:
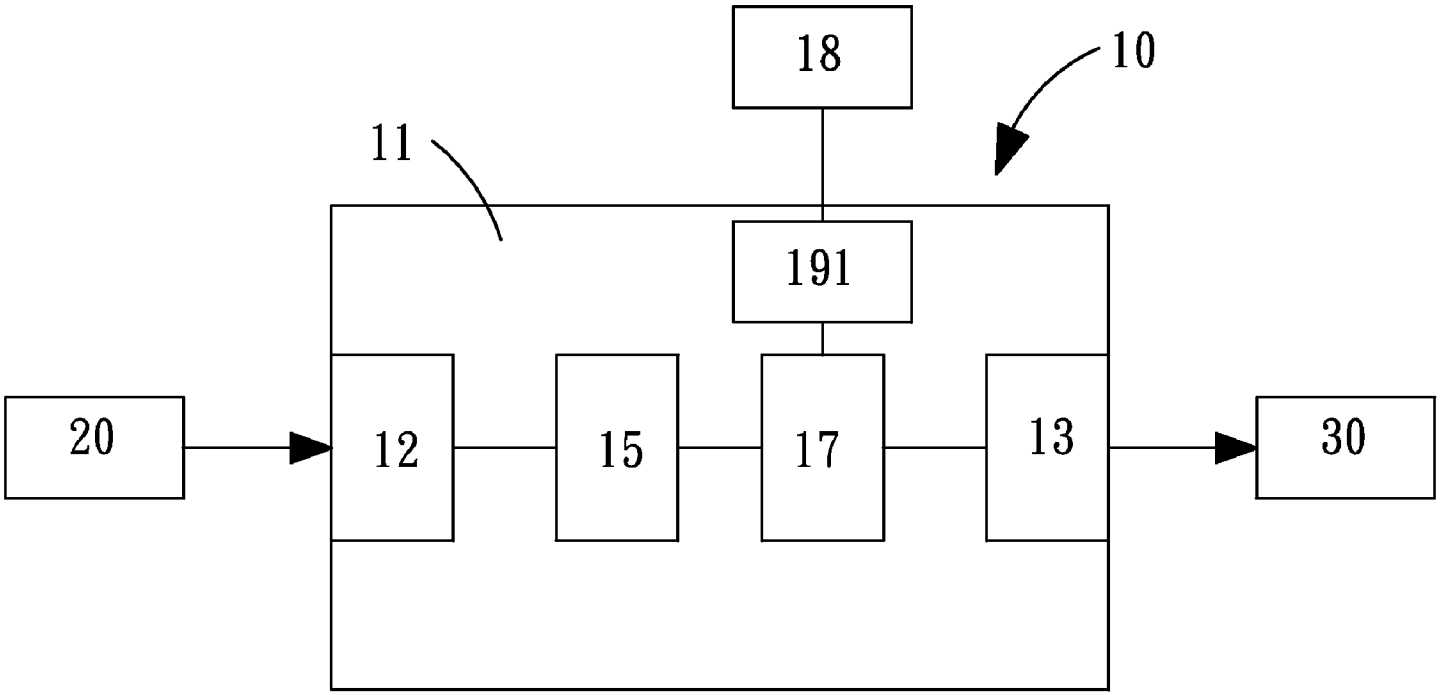
FIG. 11 is a block diagram of an assembled architecture of a power adapter according to a fifth embodiment of the present invention.
Figure 12:
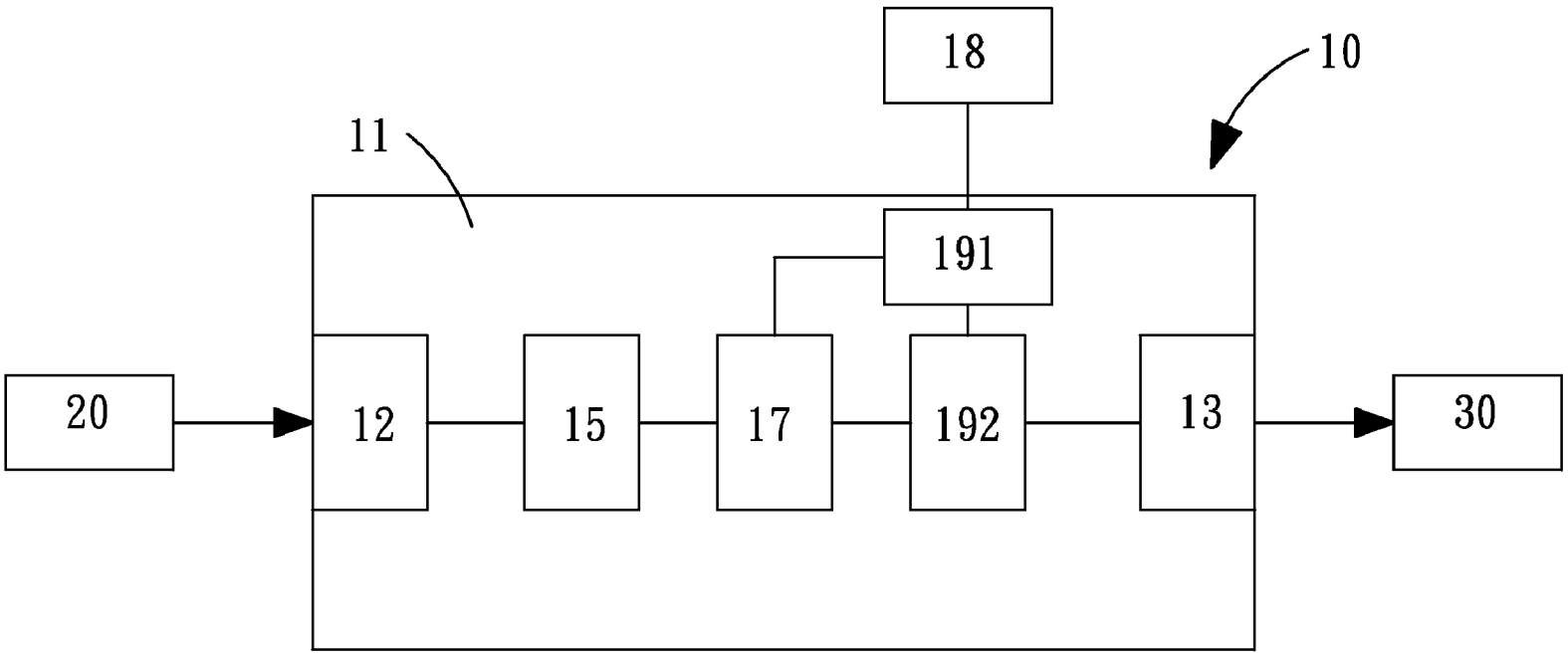
FIG. 12 is a block diagram of an assembled architecture of a power adapter according to a sixth embodiment of the present invention.

Further, the detection circuit 17 of the invention can detect the current transmission status of the first coupling portion 12 and the second coupling portion 13, and the main body 11 is equipped with a display module 18, as shown in FIG. 11, for displaying the operation status of the power adapter. A microcontroller 191 is disposed inside the main body. The microcontroller 191 is electrically connected to the detection circuit 17 and the display module 18 to have a plurality of control modes corresponding to the display module 18. The microcontroller is used for receiving signals of the detection circuit 17 and controlling the operation of the display module 18. A switch circuit 192 is further disposed inside the main body 11 as shown in FIG. 12. The switch circuit 192 is electrically connected to the first coupling portion 12, the second coupling portion 13 and the microcontroller 191. The microcontroller 19 controls the motion of the switch circuit 192 based upon the signal transmitted by the detection circuit 17 so as to control whether or not the circuits of the first coupling portion 12 and the second coupling portion 13 are conducted. Accordingly, the second coupling portion 13 is automatically interrupted under a condition of no charging power normally, thereby preventing the service life of the electronic product from being influenced by unusual power supply.

The power adapter of the invention does not only utilize the first coupling portion and the second coupling portion of the main body to electrically connect the electronic product and the power supply device, but also selects a side of the main body connected to the power supply device and the electronic product to compose a desire junction by utilizing magnets. Therefore, when the electronic product is urgently needed, the electronic product can be separated from the power supply device by slightly imposing forces. The electronic product can be quickly taken without influencing the operation of the electronic product such that the practicality and the convenience of the power adapter can be relatively improved.

The preferable power adapter improves over the prior art and complies with patent application requirements, and thus is duly filed for patent application. While the invention has been described by device of specific embodiments, numerous modifications and variations could be made thereto by those generally skilled in the art without departing from the scope and spirit of the invention set forth in the claims.

What is claimed is:

1. A power adapter comprising:

a main body;

a first coupling portion, disposed to the main body, having electrode contacts with predetermined numbers/formats;

a second coupling portion, disposed to the main body to electrically connect the first coupling portion, having a permanent magnet;

a magnetic attraction portion, disposed to an end of the main body relatively having the first coupling portion;

a voltage step-down circuit disposed inside the main body and electrically connected to the first coupling portion and the second coupling portion; and a detection circuit disposed inside the main body, the detection circuit electrically connected to first coupling portion, the second coupling portion and the voltage step-down circuit, an output voltage of the voltage-step down circuit being automatically regulated upon a detection result of the detection circuit, wherein several slot holes are axially arranged to the main body, and the electrode contact of the second coupling portion has an electrode spindle and an electrode bushing stretching out the main body, and several movable conduction sleeves are sequentially laminated over the electrode bushing to relatively shift between movable conduction sleeves and to retain a junction effect through mutual contacting, and the movable conduction sleeve at an extreme inner layer rubs against the electrode bushing, and several push buttons pierce through the slot hole of the main body, and each push button is connected to the movable conduction sleeve to form a linking effect together with the movable conduction sleeve.

2. The power adapter as recited in claim 1, wherein each push button is equipped with a clamping port at a side of the main body, and a tail of each movable conduction sleeve is bent with a protrusion plate provided for inserting into the clamping port of the push button, and a tail of the movable conduction sleeve, which is relatively disposed to an outer layer, is equipped with a trough that is passed by the protrusion plate of the movable conduction sleeve.

3. The power adapter as recited in claim 1, wherein each push button is disposed with a positioning cavity at a wall surface, and the main body has flexible protruding buckles at two ends of a sliding stroke performed by the push button in each slot hole to cross the positioning cavity of the push button.

* * * * *